US008461761B2

(12) United States Patent
Neate

(10) Patent No.: US 8,461,761 B2
(45) Date of Patent: Jun. 11, 2013

(54) LUCENT PLASMA CRUCIBLE

(75) Inventor: Andrew Simon Neate, Aylesbury (GB)

(73) Assignee: Ceravision Limited

( * ) Notice: Subject to any disclaimer, the term of this patent is extended or adjusted under 35 U.S.C. 154(b) by 445 days.

(21) Appl. No.: 12/780,908

(22) Filed: May 16, 2010

(65) Prior Publication Data

US 2010/0270920 A1 Oct. 28, 2010

Related U.S. Application Data

(63) Continuation-in-part of application No. 12/671,088, filed as application No. PCT/GB2008/003829 on Nov. 14, 2008, now Pat. No. 8,089,203, which is a continuation-in-part of application No. PCT/GB2010/000900, filed on May 7, 2010.

(60) Provisional application No. 61/241,305, filed on Sep. 10, 2009.

(51) Int. Cl.
*H01J 65/04* (2006.01)
*H01J 61/30* (2006.01)

(52) U.S. Cl.
USPC ..... 313/607; 313/634; 313/493; 313/161; 315/248

(58) Field of Classification Search
None
See application file for complete search history.

(56) References Cited

U.S. PATENT DOCUMENTS

| | | | | |
|---|---|---|---|---|
| 4,266,167 | A | 5/1981 | Proud | |
| 5,227,698 | A | 7/1993 | Simpson | |
| 5,834,895 | A | 11/1998 | Dolan | |
| 6,093,921 | A | 7/2000 | Gaisford | |
| 2002/0011802 | A1 | 1/2002 | Espiau | |
| 2005/0057158 | A1 * | 3/2005 | Chang et al. | 315/39 |
| 2005/0286263 | A1 | 12/2005 | Champion | |
| 2007/0171006 | A1 | 7/2007 | Devincentis | |
| 2009/0026911 | A1 * | 1/2009 | Hafidi et al. | 313/231.61 |

FOREIGN PATENT DOCUMENTS

| | | |
|---|---|---|
| WO | 2005117069 | 12/2005 |
| WO | 2006129102 | 12/2006 |
| WO | 2011015807 | 2/2011 |
| WO | 2011048359 | 4/2011 |

* cited by examiner

*Primary Examiner* — Ashok Patel
(74) *Attorney, Agent, or Firm* — Jennifer Meredith, Esq.; Meredith & Keyhani, PLLC

(57) ABSTRACT

A lucent plasma crucible having a closed body for enclosing a fill material filled in a void formed within the closed body and enclosed by the closed body, the fill material being excitable by microwave energy to generate a light-emitting plasma. The crucible is dimensioned to have low order TE or TM microwave mode properties. The orders of the modes are 0, 1 or 2. Crucibles may be regular or irregular in shape. For circular cylindrical crucibles having diameter (d) in cm, length (l) in cm, and operating frequency (f) in MHZ, $(d/l)^2$ is between 0 and 100, and $(d\times f)^2$ is between 0 and $2\times10^9$. Also $0<(d/l)^2<20$ and $0<(d\times f)^2<1.5\times10^9$ may be used.

16 Claims, 10 Drawing Sheets

LUCENT PLASMA CRUCIBLE

CROSS-REFERENCE TO RELATED APPLICATIONS

This application is a continuation-in-part of U.S. application Ser. No. 12/671,088 filed on Apr. 1, 2010 now U.S. Pat. No. 8,089,203, at the U.S. Patent and Trademark Office and entitled "Light Source." This application also claims priority to provisional U.S. Patent Application No. 61/241,305 filed Sep. 10, 2009, at the U.S. Patent and Trademark Office and entitled "Light Source." This application further claims priority to United Kingdom application number 0908727.1 filed on May 20, 2009. This application claims priority to and is a continuation-in-part of co-pending application number PCT/GB2010/000900 filed May 7, 2010.

Co-pending U.S. patent application Ser. No. 12/671,088, is a national stage entry of PCT/GB08/03829 filed on Nov. 14, 2008, which claims priority from United Kingdom applications number 0722548.5, filed on Nov. 16, 2007, number 0809471.6, filed on May 23, 2008, number 0814699.5, filed on Aug. 12, 2008, and number 0814701.9 filed on Aug. 12, 2008, the entire contents of all of which are also incorporated by this reference. The contents of all of these applications (Ser. No. 12/671,088, 0908727.1, 61/241,305, PCT/GB2010/000900, PCT/GB08/03829, 0722548.5, 0809471.6, 0814699.5, 0814701.9) are incorporated herein by this reference.

BACKGROUND OF THE INVENTION

1—Field of the Invention

The present invention relates to plasma crucibles and to light sources that include plasma crucibles.

2—Description of Related Art

In plasma lamps a discharge is used to excite a gas in a capsule with a view to producing light. Typical examples of plasma lamps include sodium discharge lamps and fluorescent tube lamps. The fluorescent tube lamps use mercury vapor, which produces ultraviolet radiation. In turn, the ultraviolet radiation excites a fluorescent powder to produce light. Such lamps are more efficient than tungsten filament lamps in terms of lumens of light emitted per watt of electricity consumed. However, they still suffer the disadvantage of requiring electrodes within the capsule. Since the electrodes carry the current required for the discharge, they degrade and ultimately fail.

SUMMARY OF THE INVENTION

Aspects of the present invention provide a lamp that comprises a light source in the form of a light emitting resonator, a magnetron and a stub tuner. A reflector is fitted at the junction of the light source and the stub tuner, for directing the light in a generally collimated beam. The light emitting resonator comprises an enclosure formed of inner and outer envelopes of quartz. These are circular cylindrical tubes with respective end plates. A tungsten wire mesh, of a mesh size to exhibit a ground plane to microwaves within the resonator, is sandwiched between the tubes and the end plates respectively. Each envelope, comprised of its tube and end plates is hermetic. An earth connection extends from the mesh to the outside of the envelope. The length axially of the enclosure between the wire mesh sandwiched between the end plates is $\lambda/2$ for the operating microwave frequency. At one end of the enclosure, a molybdenum drive connection extends to a tungsten disc. This is arranged transverse the axis A of the enclosure at $1/16\lambda$ from the mesh at its end of the enclosure. The enclosure is filled with excitable plasma material, such as a dose of metal halide in a rare earth gas. The disc acts as antenna and is driven by the magnetron, via the matching circuit.

Aspects of the present invention provide a lucent plasma crucible having a closed body for enclosing a light-emitting plasma, a void formed within the closed body and enclosed by the closed body, and a fill material filled in the void, the fill material being excitable by microwave energy to generate and form a light emitting plasma. Further, the lucent plasma crucible is dimensioned to have low order transverse electric microwave mode properties, or low order transverse magnetic microwave mode properties. In one exemplary aspect of the present invention, the orders of the modes are 0, 1 or 2.

The crucibles may be made in regular or irregular shapes. In one exemplary aspect of the present invention, circular cylindrical lucent crucibles are used. In other aspects, rectangular crucibles are suitable.

In one aspect of the present invention, for circular cylindrical crucibles, diameter (d), length (l) and operating frequency (f) fall within the following ranges—with (d) and (l) in cm and (f) in MHz: the square of the quotient formed by diameter divided by the length, $(d/l)^2$, is between 0 and 100, and the square of the product of diameter times frequency, $(d\times f)^2$, is between 0 and $2\times10^9$. In one exemplary aspect: $0<(d/l)^2<20$ and $0<(d\times f)^2<1.5\times10^9$.

One aspect of the present invention provides a lucent crucible of quartz for operation in the TM010 mode at 2450 MHz. The lucent crucible has a cylindrical shape of 4.9 cm in diameter and 2.1 cm in length. A sealed void is formed centrally within the cylindrical crucible along a central axis of the crucible, with an antenna re-entrant at one end, but offset from the central axis of the crucible and close to the central void. The void is filled with plasma generating material.

DETAILED DESCRIPTION OF THE INVENTION

Figure 1:
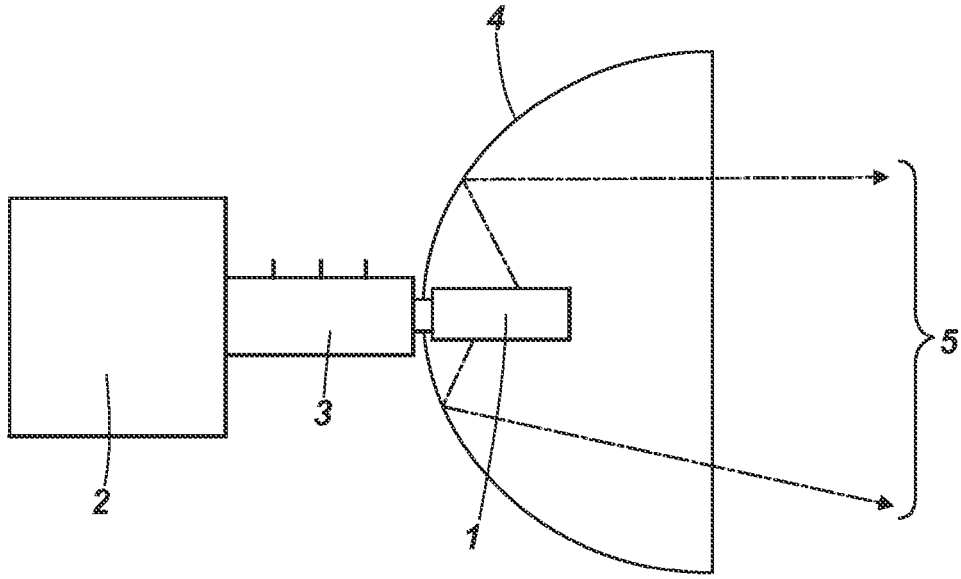
FIG. 1 a side view of a light source according to aspects of the invention in combination as a lamp with a microwave drive circuit.
Figure 2:
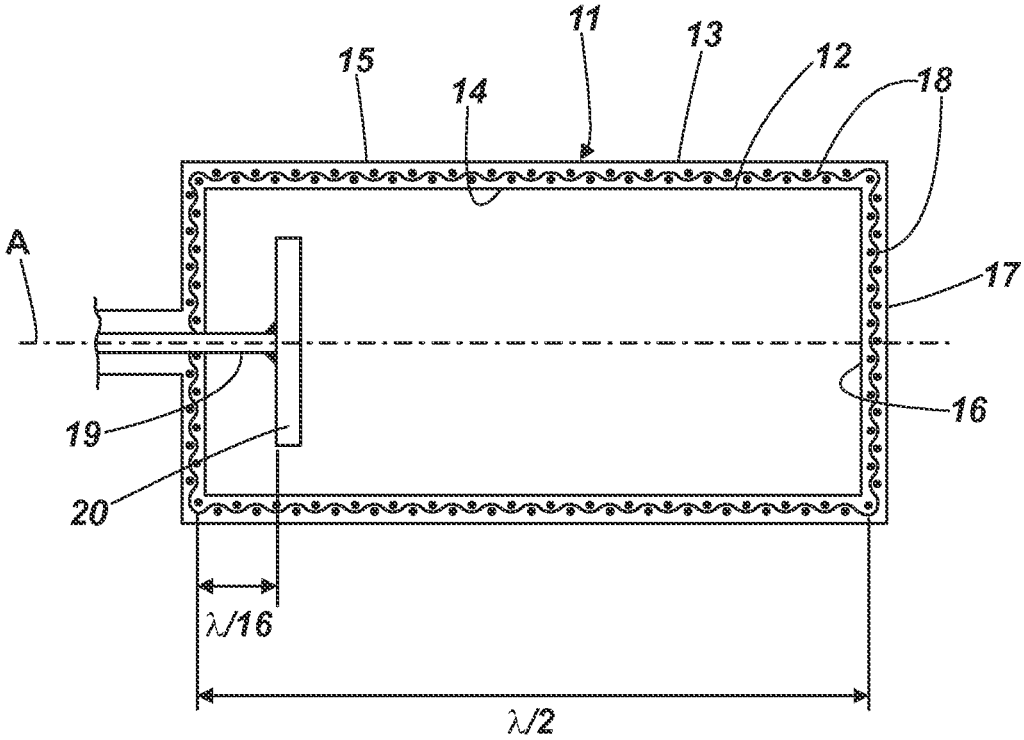
FIG. 2 is the light source in the lamp of FIG. 1, shown on a larger scale.
Figure 3:
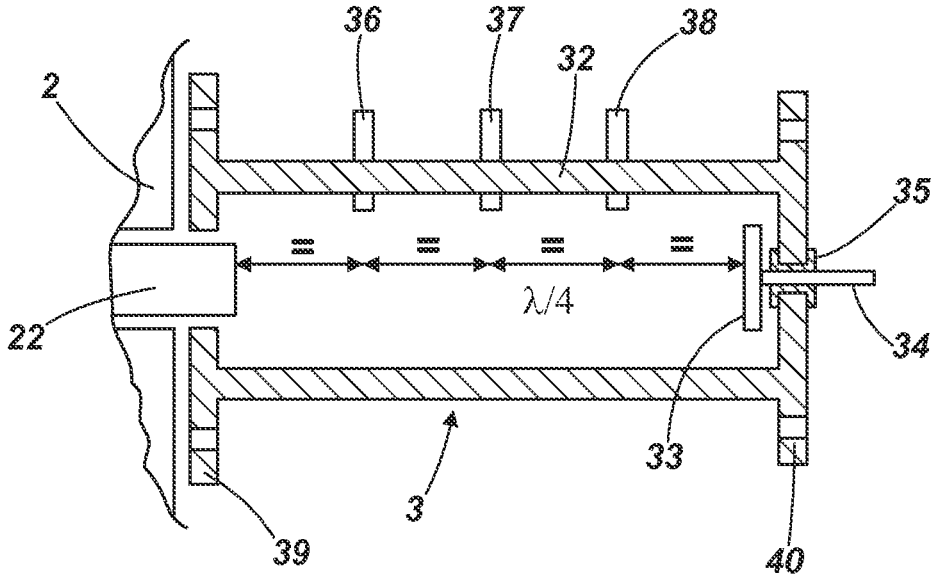
FIG. 3 is a similar view of the stub tuner of the microwave drive circuit of FIG. 1.
Figure 4:
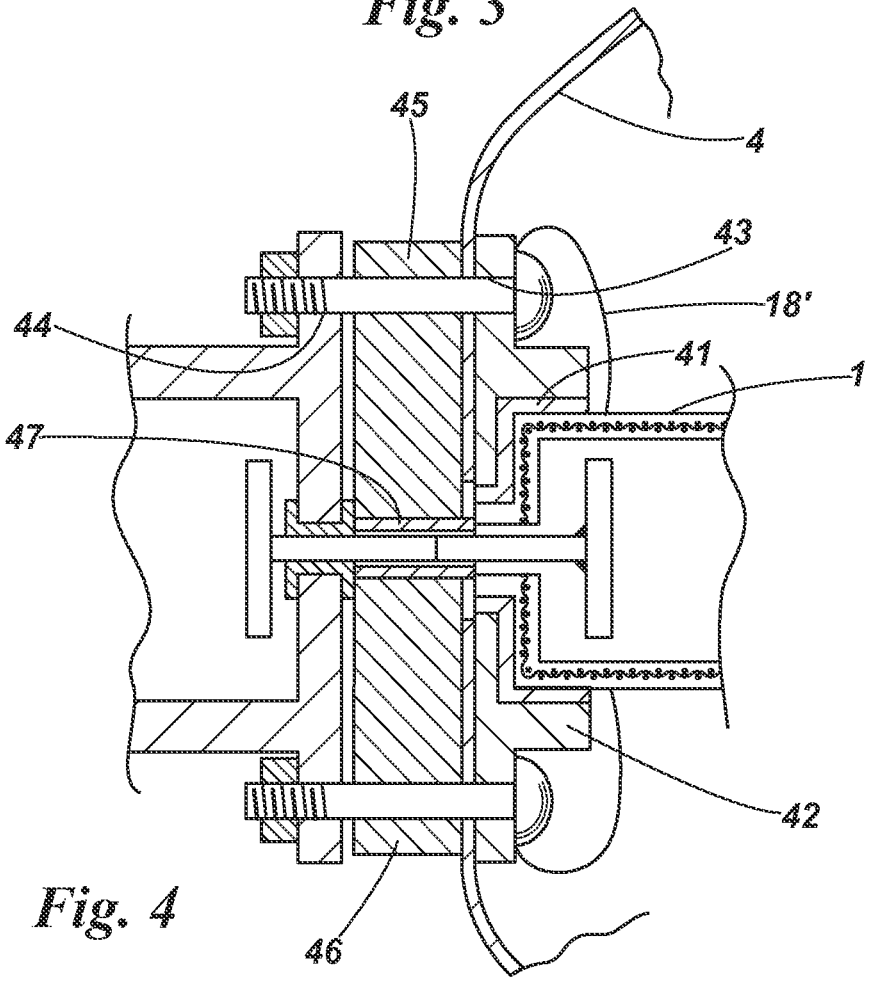
FIG. 4 is a scrap cross-sectional view of the junction between the light source and the stub tuner.

Electrodeless bulb lamps are shown in patent applications PCT/GB2006/002018 for a lamp, PCT/GB2005/005080 for a bulb for the lamp and PCT/GB2007/001935 for a matching circuit for a microwave-powered lamp. These all relate to lamps operating electrodelessly by use of microwave energy to stimulate light emitting plasma in the bulbs. Earlier proposals involving use of an airwave for coupling the microwave energy into a bulb have been made for instance in U.S. Pat. No. 5,334,913. If an air wave guide is used, the lamp is bulky, because the physical size of the wave guide is a fraction of the wave length of the microwaves in air. This is not a problem for street lighting for instance but renders this type of light unsuitable for many applications. For this reason, the lamp in PCT/GB2006/002018 uses a dielectric wave-guide, which substantially reduces the wave length at the operating frequency of 2.4 Ghz. This lamp is suitable for use in domestic appliances such as rear projection television.

Further, it is possible to coalesce the bulb and the wave guide into a single component.

Some aspects of the present invention provide an improved lamp having such a coalesced bulb and wave-guide.

Some aspects of the present invention provide a light source to be powered by microwave energy, the source having:

- a solid plasma crucible of material which is transparent or translucent for exit of light therefrom, the plasma crucible having a sealed void circumscribed by the plasma crucible,
- a Faraday cage surrounding the plasma crucible, the cage being at least partially light transmitting for light exit from the plasma crucible, whilst being microwave enclosing,
- a fill in the void of a fill material excitable by microwave energy to form a light emitting plasma therein, and
- an antenna arranged within the plasma crucible for transmitting plasma-inducing microwave energy to the fill, the antenna having:
- a connection extending outside the plasma crucible for coupling to a source of microwave energy;

wherein the arrangement is such that light from a plasma in the void can pass through the plasma crucible and radiate from it via the cage.

As used in this specification: "lucent" means transparent or translucent to light and "plasma crucible" means a closed body enclosing a plasma, the plasma being generated and contained in the void when a fill material filled in the crucible is excited by microwave energy from the antenna.

The crucible may be made from a solid, dielectric material.

The solid plasma crucible could have varying structures and compositions throughout its volume, particularly where it is comprised of more than one piece sealed together. Alternatively the entire crucible may be made from material that remains substantially homogenous throughout the volume of the crucible.

Research into microwave drive of light emitting plasmas, typically using separate bulbs mounted in waveguides, indicates that at least fundamental resonance in a resonant wave guide is not essential for transmission of microwave energy into the excitable material. Accordingly the solid plasma crucible having the void, the fill, and the antenna need not be a resonant waveguide. Nevertheless resonance may be employed. For instance in the one of the embodiments described below, the plasma crucible is of circular cross-section and is dimensioned for a half wave to extend diametrically within it.

The light source will normally be used with its light being reflected in a particular direction. An external reflector may be provided or as in the second embodiment, the plasma crucible may be contoured to reflect light in a particular direction. The contoured surface may be polished and rely on total internal reflection. Alternatively, it may be metallized to enhance reflection. In this case, the metallization may form part of the Faraday cage. In another alternative, the plasma crucible may be mated with a complementary reflector, positioned to reflect light back through the plasma crucible.

In one aspect the plasma crucible may be of quartz or sintered, transparent ceramic material, although other materials may also be suitable. In particular, the ceramic material can be translucent or transparent. An example of a suitable translucent ceramic is polycrystalline alumina and example of a transparent ceramic is polycrystalline Yttrium Aluminum Garnet—YAG. Other embodiments may use Aluminum Nitride and single crystal sapphire.

The Faraday cage can be provided by coating the plasma crucible with a thin layer of conductive, transparent material, such as indium, tin oxide (ITO). Alternatively the plasma crucible can be encased in a mesh of conductive wire. Again the conductive mesh can be fused into the material of the plasma crucible, with plasma crucible material extending outside the mesh.

The antenna may extend into the plasma void, when of suitable material to resist attack by the fill particularly where the plasma crucible has a wall thickness that is small in comparison with distance within the plasma crucible from the Faraday cage at one side or end and to the other side or end. In this case, resonance can be established predominantly within the void. Such an antenna can be a rod extending into the void, but may also be a plate, typically a disc, arranged transversely of the length of the plasma crucible. The connection for the antenna can extend sideways out of the plasma crucible in or close to a plane of the antenna; or, it can extend axially out of the plasma crucible, transversely of a plane of the antenna.

Alternatively, the antenna can be a rod of conductive metal extending within a re-entrant in the plasma crucible. Such re-entrant can be a thin walled projection into the void, with the rod antenna acting similarly to the plate antenna just mentioned. The re-entrant can be parallel to a length of the void or transverse to it. As an alternative, where the void is small in comparison with distance within the plasma crucible from the Faraday cage at one side or end and to the other, the re-entrant can be alongside the void, with resonance being established across the plasma crucible, largely within the plasma crucible. In this case, the plasma crucible will have a dielectric constant greater than that of the ambient atmosphere and the wave length of the resonance will be shorter than its free space wavelength.

Whilst the plasma crucible can be one or an integer multiple of one wavelength of resonant microwaves within the plasma crucible, it can also be one half of the wave length.

The fill material can be any of a number of elements known to emit light from a plasma, either alone or in combination.

The Faraday cage includes at least one aperture for locally increasing light transmission therethrough. Usually, the aperture will be no bigger than one tenth of the free space wave length of the microwaves in the crucible. Typically for operation at 2.45 GHz, the aperture would be no bigger than 1/10× 12.24 cm, i.e. 12.24 mm and for 5.8 GHz no bigger than 6.12 mm.

More than one aperture can be provided. For instance, where light is taken both axially and radially from the crucible, correspondingly positioned apertures can be provided.

Provision of the apertured region allows radiation of more light from the light source than would be the case in its absence.

In one aspect of the present invention, the lucent plasma crucible has:

a bore having a step and a counter-bore extending from the void to a surface of the crucible, and a plug of lucent material in the counter-bore and sealed to the crucible.

The step and the void can be formed by mechanical boring of the material of the crucible or other forming means, such as casting.

Whilst it is anticipated that with compatible coefficients of thermal expansion, as between artificial sapphire for the plug and lucent alumina for the crucible, the plug and crucible can be of different materials, normally they will be of the same material, typically quartz.

Again the plug can be sealed with a fusible material between the plug and the crucible, such as frit. In one aspect of the present invention, the plug and the crucible are sealed by fusing of their own material. For fusing, the crucible can be heated as a whole. However local heating may also be confined to the region of fusing. Typically this can be done with a laser.

The plug can be of the same depth as the step, in which case, the plug is flush with the surface of the crucible. However, the plug can be proud of the surface. These two alternatives are suitable where the void is to be close to the surface of the crucible. In a third alternative where the void is to be deeper in the crucible, the plug is recessed. In this latter embodiment, the length of the counter-bore to the surface can be filled with a further plug of the same material fixed, but not necessarily sealed, in the counter-bore, with the further plug flush with the surface. This arrangement allows the void to be central in the crucible and the crucible to appear—as regards its dielectric material—to behave as a single solid body (with the central void).

In one aspect of the present invention, the light source is combined into a lamp with a source of microwaves and a matching circuit as a single integrated structure.

Whilst the microwave source can be a solid state oscillator and amplifier, in one embodiment, in view of the output, the source is a magnetron. In one aspect of the present invention, the power of the magnetron will be 1 kW.

In one embodiment, the matching circuit is a stub tuner, and may be a three-stub tuner.

It should be noted that whereas usually light source of the invention are expected to be used for producing visible light, they are suitable for producing invisible light, for example ultra violet light, as well.

Referring to FIGS. 1 to 5 of the drawings, a lamp of the invention comprises a light source in the form of a light emitting resonator 1, a magnetron 2 and a stub tuner 3. A reflector 4 is fitted at the junction of the light source and the stub tuner, for directing the light in a generally collimated beam 5.

The light emitting resonator comprises a crucible 11 formed of inner and outer envelopes 12, 13 of quartz. These are circular cylindrical tubes 14, 15, with respective end plates 16, 17. A Faraday cage in the form of a tungsten wire mesh 18, of a mesh size to exhibit a ground plane to microwaves within the resonator, is sandwiched between the tubes and the end plates respectively. Each envelope, comprised of its tube and end plates is hermetic. An earth connection 18' extends from the mesh to the outside of the envelope.

The length axially of the crucible between the wire mesh sandwiched between the end plates is $\lambda/2$ for the operating microwave frequency. At one end of the crucible, a molybdenum drive connection 19 extends to a tungsten disc 20. This is arranged transverse the axis A of the crucible at $1/16\lambda$ from the mesh at its end of the crucible. The crucible is filled with excitable plasma material, such as a dose of metal halide in a rare earth gas.

The disc acts as an antenna and is driven by the magnetron 2, via the matching circuit 3. The matching circuit is an air wave guide 32 of Aluminum having the output antenna 22 of the magnetron as its input. The output antenna 33 of the matching circuit is a disc such as the resonator antenna disc and is connected to a connection 34 passing out of the matching circuit and insulated therefrom by an insulating bush 35. The matching circuit has three tuning stubs 36, 37, 38. These are arranged as $\lambda/4$, configuring the matching circuit as a stub tuner.

The matching circuit has flanges 39, 40 at its ends via which it is connected to the magnetron and the light source. The end of the latter is cemented 41 into a holder 42 of ceramic material. This has bores 43 at the same PCD as bores 44 in the flange 40 of the matching circuit and to which it is fastened by screws 45. A spacer ring 46 spaces the matching circuit and the holder, allowing the stub tuner and light source connections 34, 19 to be coaxial and connected to each other by a clip 47. The reflector 4 is also carried on the screws between the holder 42 and the spacer 46. The earth connections 18' are also connected to the screws 45.

Figure 5:
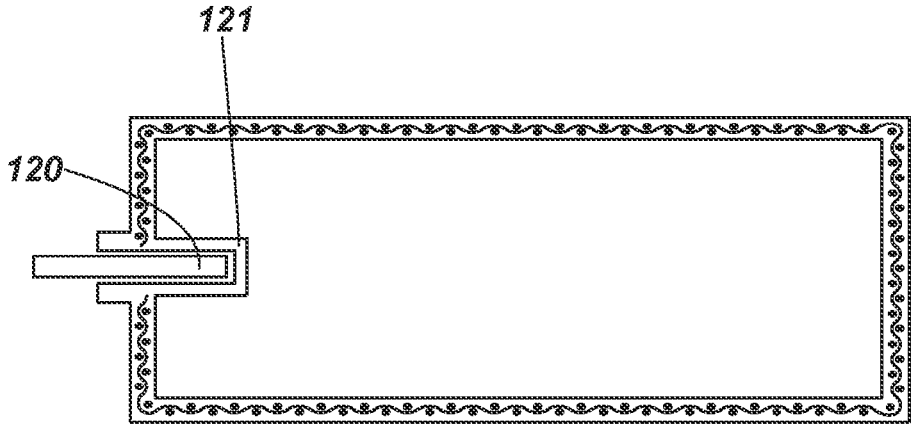
FIG. 5 is a view similar to FIG. 2 of an alternative light source.

FIG. 5 shows an alternative light-emitting resonator, also having inner and outer envelopes of quartz with a ground plane mesh between them. In place of the disc antenna 20, a rod like antenna 120 extends in a re-entrant sleeve 121 of quartz, on the central axis of the envelopes. This arrangement completely isolates the antenna from the fill contents of the crucible, which is of advantage where the fill is particularly aggressive.

In operation, the magnetron, typically rated at 1 to 5 kW, inserts resonant microwave radiation via the stub tuner and the antenna 20 or 120 into the crucible. This forms a mixed dielectric resonant cavity. The resonance builds the intensity of the electric fields in the cavity such that the fill forms a plasma which radiates light. In one aspect, the mode of resonance will be TE101. Further modes of resonance are also possible.

In one aspect of the present invention, at 5.8 GHz, the axial length of the crucible between the mesh at opposite ends and allowing for 1.5 mm of individual envelope wall thickness is 72 mm and the diameter is 31 mm. It will be appreciated that such a size, whilst too large for most domestic uses, is entirely suitable for illuminating larger environments.

The stub tuner can have internal dimensions of 114×40×20 mm. The stubs are set of the median plane by $1/16\lambda$.

It is possible to replace the quartz material of the plasma crucible with transparent ceramic, in which case the connector in contact with the ceramic can be of niobium. Further in place of the mesh within the crucible walls, the crucible can be coated with an indium tin oxide—ITO—conductive coating.

Figure 6:
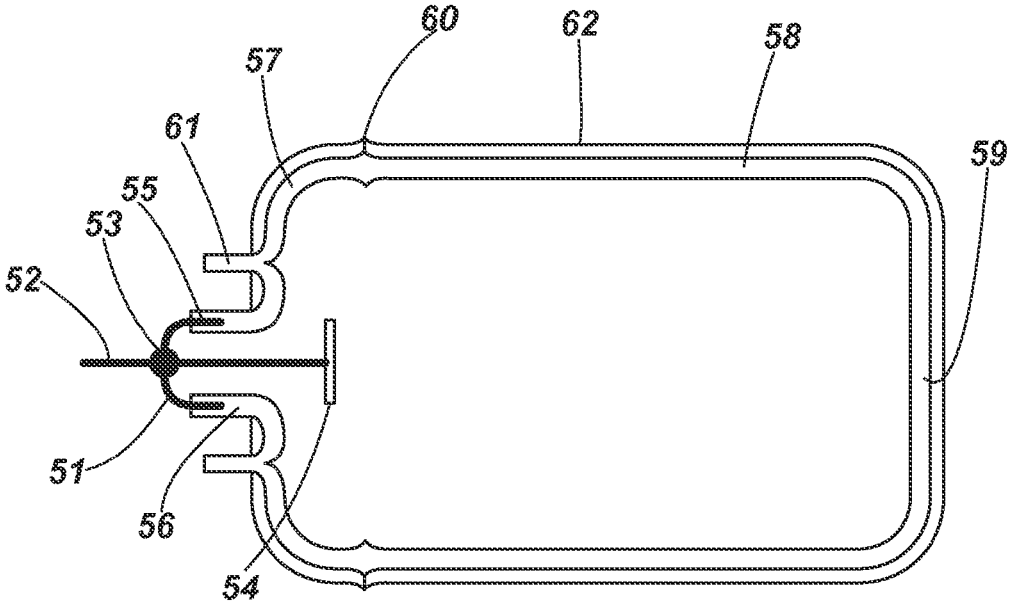
FIG. 6 is a perspective view of a plasma crucible of another light source of the invention.

As shown in FIG. 6, the light source can be constructed with a with a sub-assembly of an molybdenum end cap 51 having a molybdenum rod 52 brazed 53 into it and carrying a tungsten antenna 54. The edge 55 of the cap is let into a neck 56 of the quartz end cover 57 of the crucible. This sub-assembly is sealed on the cylindrical body 58 and opposite end 59 of the crucible at a seal 60. The cover 57 has a charge tube 61, through which the excitable material charge and noble gas fill can be introduced. The tube is sealed off. The Faraday cage 62 is provided in the form of an ITO coating.

Figure 7:
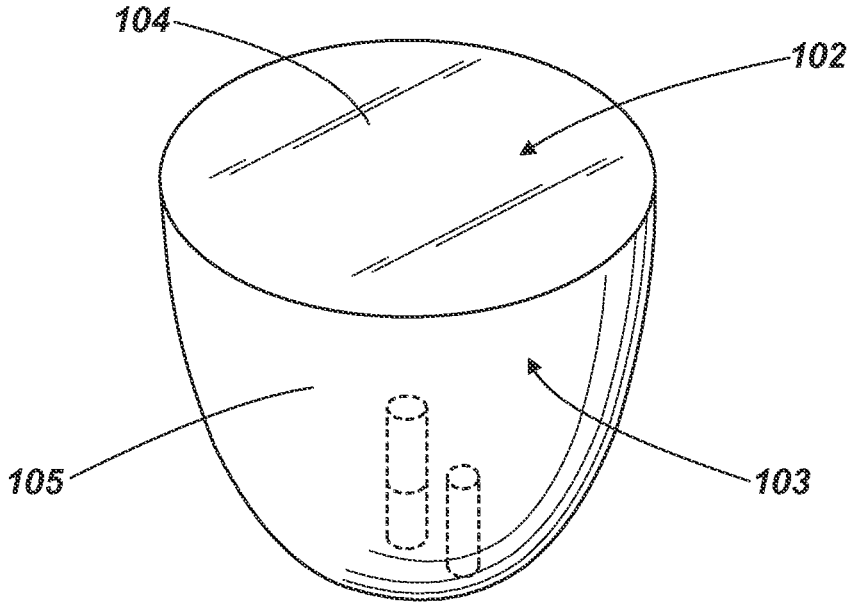
FIG. 7 is a perspective view of a lucent plasma crucible for a further light source of the invention.
Figure 8:
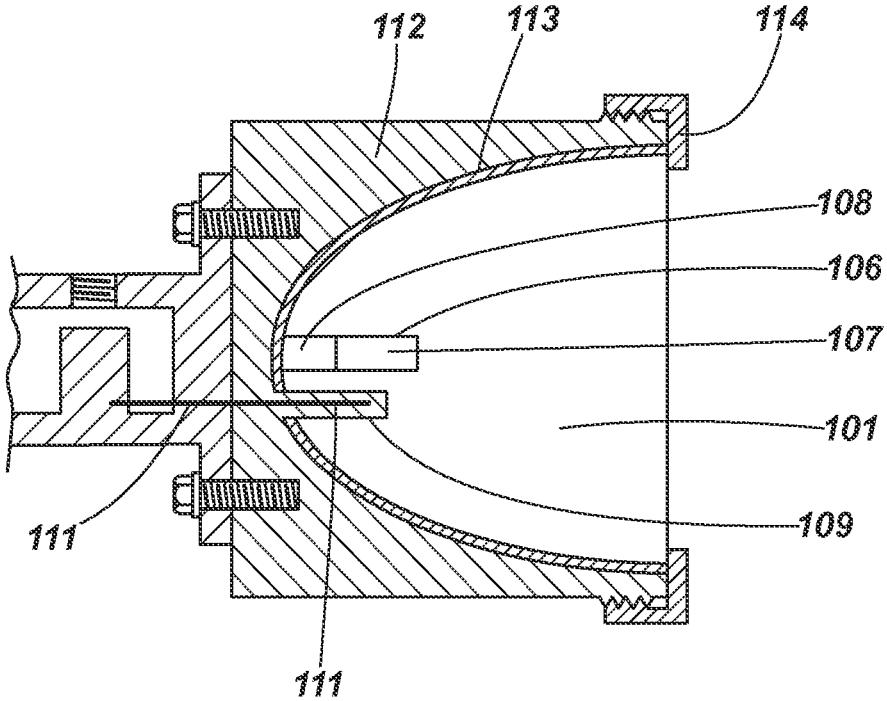
FIG. 8 is a cross-sectional side view of the further light source, including a portion of a matching circuit and an adapter for the plasma crucible.

Turning on now to FIGS. 7 and 8, another lamp of the invention will now be described. It has a solid plasma crucible 101 of polished quartz, with a flat front face 102 and a parabolic rear face 103. The front face is coated with indium tin oxide 104 to render it electrically conductive, yet transparent. In electrical contact with the ITO layer, is a platinum layer 105 on the parabolic rear. These two layers together form a Faraday cage around the quartz plasma crucible.

At the focus of the parabola and aligned with its central axis is a void 106, filled with microwave excitable material 107, typically indium halide in xenon. The void is a bore in the quartz, that is sealed by means of a plug 108, the plug having been fused in place without other material by laser sealing.

Alongside the void is a receptacle 109 in the quartz for a metal rod antenna 110. This is connected directly to the output 111 of a matching circuit such as the circuit 3. An adaptor plate 112 of the circuit has a contour 113 complementary to that of the rear face of the quartz plasma crucible. A fastening ring 114 pulls the quartz into contact with the end plate, for grounding of the Faraday cage.

On propagation of microwaves from the matching circuit, resonance is set up in the quartz plasma crucible and a plasma is established in the void. Light is emitted from the halide in the void. This either leaves the plasma crucible directly through the front face 102 or is reflected by the platinum layer 105 at the parabolic back face 103 forwards to exit the front face.

Typically, the quartz plasma crucible is 49 mm in diameter for 2.4 GHz microwaves and 31.5 mm for 5.8 GHz. In either case, the void is 5 mm in diameter and the plug is 8 mm long, leaving a 10 mm long void. The antenna receptacle 109 is 2 mm in diameter, being 5 mm eccentric from the void, which is on the central axis of the plasma crucible.

It should be noted that by comparison with prior electrodeless lamps using small bulbs in opaque wave guides, where the light exit is restricted to the diameter of the bulb, not only can light exit from the full front face of the wave guide, which is significantly larger than the diameter of the plasma void 106, sideways and rearwards propagating light is reflected forwards and out of the lamp.

Figure 9:
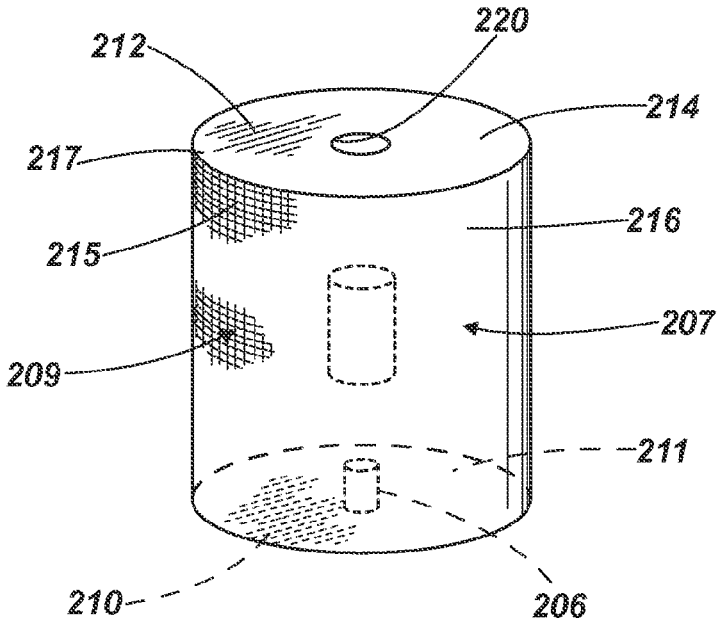
FIG. 9 is a perspective view of a lucent plasma crucible for another light source of the invention.
Figure 10:
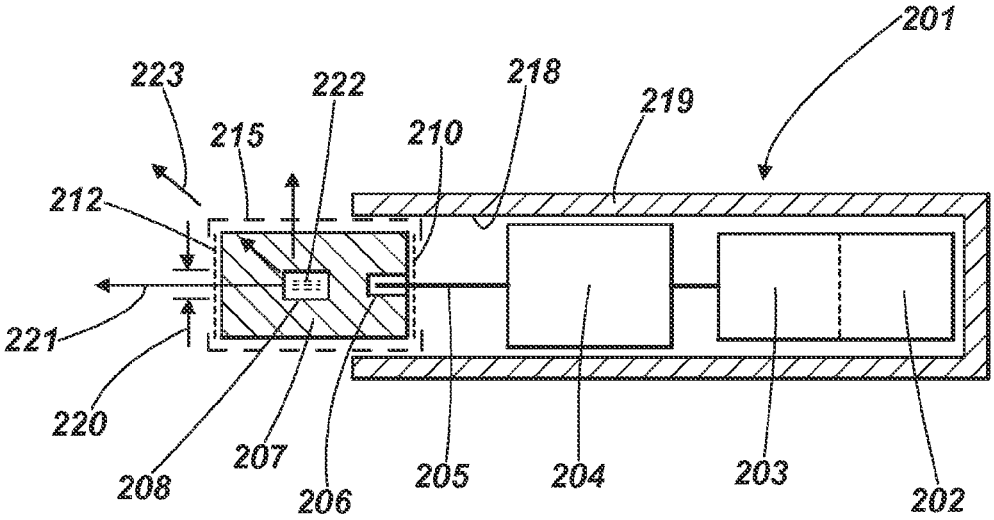
FIG. 10 is a diagrammatic view of a microwave powered lamp including the lucent plasma crucible of FIG. 9.

Referring to FIGS. 9 and 10, a lamp 201 comprises an oscillator 202 and amplifier 203 together forming a source of microwave energy, typically operating at 2.45 or 5.8 GHz or other frequencies within an ISM band. The source passes the microwaves via a matching circuit 204 to an antenna 205 extending into a re-entrant 206 in a lucent, plasma crucible 207. This is of quartz and has a central void 208 containing a fill of noble gas and a microwave excitable material, which radiates light when excited by microwaves. The quartz being transparent, light can leave it in any direction, subject to the constraints provided by the Faraday cage described below.

The crucible is a right circular cylinder, 63 mm long and 43 mm in diameter. Centrally in the crucible, the void is 10 mm long and 3 mm in diameter. The re-entrant is co-axial with the void, being 2 mm in diameter and 10 mm long.

A Faraday cage 209 surrounds the crucible and comprises:

- a light reflective coating 210, typically of silver with silicon monoxide, across the end surface 211 having the antenna re-entrant,
- an indium tin oxide (ITO) deposit 212 on the end surface 214, and
- a conductive, chemical-vapor-deposited mesh 215 on the cylindrical surface 216, the mesh having fingers 217 which extend onto the ends, for electrical interconnection of the elements 210, 212 and 215. The lines of the mesh are 0.5 mm wide and set at a pitch of 6.0 mm.

The Faraday cage is earthed by being received in a recess 218 in a housing 219.

The ITO deposit has an un-plated 12 mm aperture 220 centrally placed in the end face 214, whereby light 221 from the end of the plasma discharge 222 in the void can pass directly out of the lucent plasma crucible, without attenuation in by the Faraday cage. Much light also passes out via the Faraday cage, although attenuated to an extent.

It should be noted that Faraday cage can be formed entirely of wire mesh formed around the crucible, with an aperture in line with the void.

Figure 11:
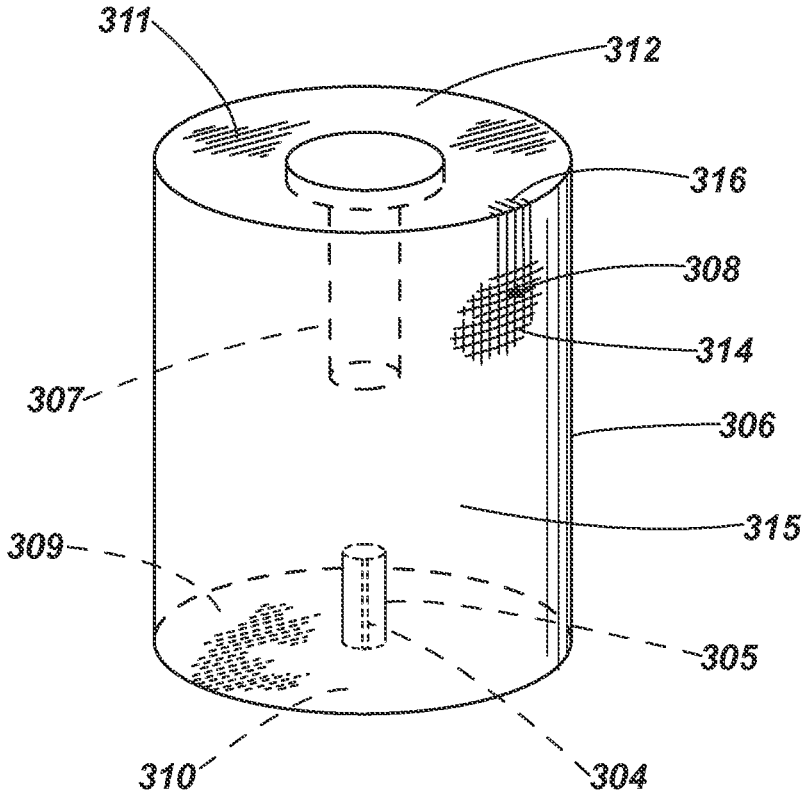
FIG. 11 is a perspective view of a further lucent plasma crucible according to aspects of the invention for a microwave powered lamp.
Figure 12:
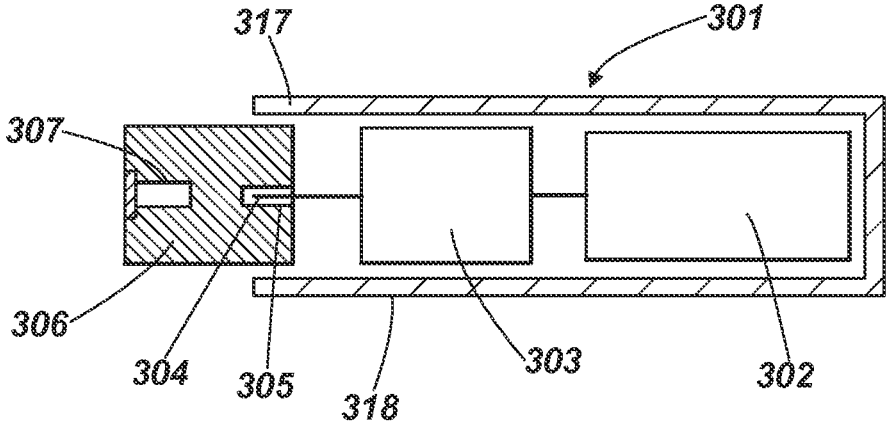
FIG. 12 is a diagrammatic view of a microwave powered lamp including the lucent plasma crucible of FIG. 11.

Referring to FIGS. 11 and 12 of the drawings, a lamp 301 comprises an oscillator and amplifier source 302 of microwave energy, typically operating at 2.45 or 5.8 GHz or other frequencies within an ISM band. The source passes the microwaves via a matching circuit 303 to an antenna 304 extending into a re-entrant 305 in a lucent, plasma crucible 306. This is of quartz and has a central void 307 containing a fill of noble gas and a microwave excitable material, which radiates light when excited by microwaves. The quartz being transparent, light can leave it in any direction, subject to the constraints provided by the Faraday cage described below.

In one aspect of the present invention, the crucible is a right circular cylinder, 63 mm long and 43 mm in diameter. Centrally in the crucible, on its central longitudinal axis A, the void is 10 mm long and 3 mm in diameter. The re-entrant is co-axial with the void, being 2 mm in diameter and 10 mm long.

A Faraday cage 308 surrounds the crucible and comprises:

- a light reflective coating 310, typically of silver with silicon monoxide, 309 across the end surface 310 having the antenna re-entrant, the plating being reflective for reflecting light from a plasma in the void out of the crucible,
- an indium tin oxide (ITO) deposit 311 on an end surface 312 of a the crucible, the ITO coating passing light from the plasma, and
- a conductive, chemical-vapor-deposited mesh 314 on the cylindrical surface 315, the mesh having fingers 316 which extend onto the ends, for electrical interconnection of the elements 309, 311 and 314. Light from the plasma can exit the crucible between the mesh lines.

The Faraday cage is earthed by being partially received in a recess 317 in an Aluminum housing 318.

The end surface 312 has a bore 321 for receiving a plug 322, of the same material as the crucible, namely quartz. The bore forms a step 324 on which the plug is located with its outer surface 325 flush with the surface 312 and to which the central void extends. The plug is sealed to the seat by laser sealing at the corner between bore 321 and the step 323.

Figure 13:
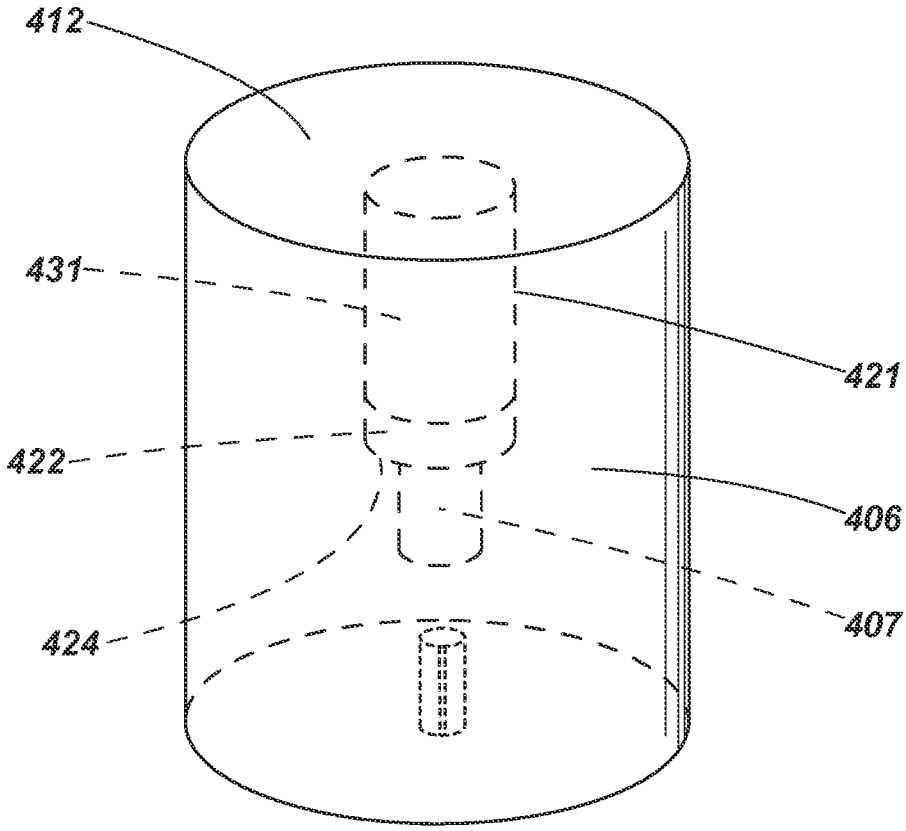
FIG. 13 is a perspective view of another lucent plasma crucible according to aspects of the invention.
Figure 14:
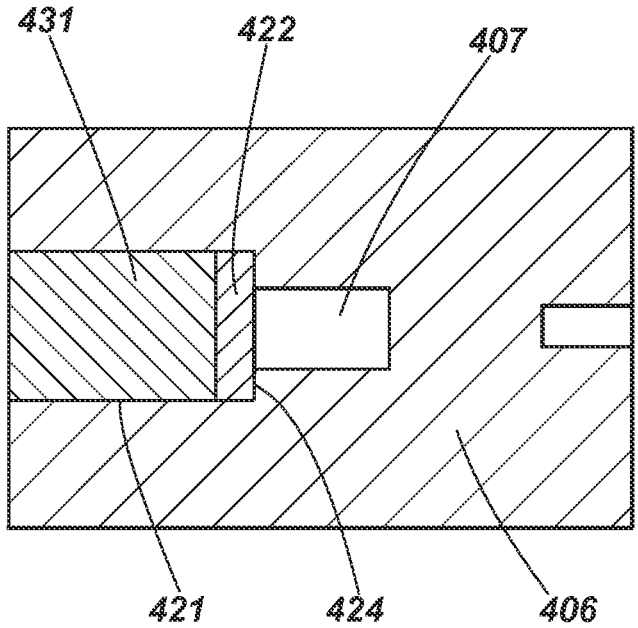
FIG. 14 is a diagrammatic view of a microwave powered lamp including the lucent plasma crucible of FIG. 13.

Turning now to FIGS. 13 and 14, the light source there shown—without any of its drive antenna, Faraday cage nor a microwave source and matching circuit shown is largely similar to that of FIGS. 11 and 12. The crucible 406 has a central void 407, which is truly at the centre of crucible, both longitudinally and diametrically whereas the void 307 is diametrically central only. The bore 421 extends deeper into the crucible with the plug 422 being of the same thickness and resting on the step 424 at the junction of the bore and the void. The plug 422 is laser sealed in the same way as the plug 322.

Outside the plug 322, in the bore 421 is a further plug 431 extending from the plug 422 to the surface 412 of the crucible. Thus for the purposes of microwave resonance, the crucible is a continuous piece of material with the dielectric constant of quartz.

The invention is not intended to be restricted to the details of the above described embodiments. For instance, the two plugs 422 and 431 could be provided as a single whole.

In PCT/GB2008/003829, invented by the inventor of the present application and assigned to the assignee of the present application, a light source in described as follows:

1. A light source to be powered by microwave energy, the source having:
   - a solid plasma crucible of material which is lucent for exit of light therefrom, the plasma crucible having a sealed void in the plasma crucible,
   - a Faraday cage surrounding the plasma crucible, the cage being at least partially light transmitting for light exit from the plasma crucible, whilst being microwave enclosing,
   - a fill in the void of material excitable by microwave energy to form a light emitting plasma therein, and
   - an antenna arranged within the plasma crucible for transmitting plasma-inducing microwave energy to the fill, the antenna having:
     - a connection extending outside the plasma crucible for coupling to a source of microwave energy;

wherein the arrangement is such that light from a plasma in the void can pass through the plasma crucible and radiate from it via the cage.

In connection with FIG. 9 and FIG. 10, which respectively show a perspective view of a lucent crucible and a diagrammatic view of a microwave powered lamp including the lucent crucible, there is described: a lamp 201 comprising an oscillator 202 and amplifier 203 together forming a source of microwave energy, that may be operating at 2.45 or 5.8 GHz or other frequencies within an ISM band. The source passes the microwaves via a matching circuit 204 to an antenna 205 extending into a re-entrant 206 in a lucent, plasma crucible 207. The crucible may be made of quartz and has a central void 208 containing a fill of noble gas and a microwave excitable material. The fill radiates light when excited by microwaves. The quartz being transparent, light can leave it in any direction, subject to the constraints provided by the Faraday cage described below.

In one aspect of the present invention, the crucible is a right circular cylinder, 63 mm long and 43 mm in diameter. Centrally in the crucible, the void is 10 mm long and 3 mm in diameter. The re-entrant is co-axial with the void, being 2 mm in diameter and 10 mm long.

A Faraday cage 209 surrounds the crucible and comprises:
- a light reflective coating 210, that may be made of silver with silicon monoxide, across the end surface 211 having the antenna re-entrant,
- an indium tin oxide (ITO) deposit 212 on the end surface 214, and
- a conductive, chemical-vapor-deposited mesh 215 on the cylindrical surface 216, the mesh having fingers 217 which extend onto the ends, for electrical interconnection of the elements 210, 212 and 215. The lines of the mesh are 0.5 mm wide and set at a pitch of 6.0 mm.

The Faraday cage is earthed by being received in a recess 218 in a housing 219.

The ITO deposit has an un-plated 12 mm aperture 220 centrally placed in the end face 214, whereby light 221 from the end of the plasma discharge 222 in the void can pass directly out of the lucent plasma crucible, without attenuation by the Faraday cage. Much light also passes out via the Faraday cage, although attenuated to an extent.

It should be noted that Faraday cage can be formed entirely of wire mesh formed around the crucible, with an aperture in line with the void.

"Lucent" is meant to indicate transparent or translucent and "plasma crucible" is a body for enclosing and containing plasma.

In the further development of the light source, alternatively shaped lucent plasma crucibles were investigated that were able to maintain microwave resonance within their Faraday cages. Accordingly, an improved lucent crucible and an improved light source are described below.

Aspects of the present invention provide a lucent plasma crucible having:
- a closed body for enclosing a light emitting plasma,
- a void in the closed body and formed by the enclosure created by the closed body, and
- a fill in the void, the fill being of material that is excitable by microwave energy to form the light emitting plasma.

Further, the lucent plasma crucible is dimensioned to have:
- low order transverse electric (TE) microwave mode properties, or
- low order transverse magnetic (TM) microwave mode properties.

In one exemplary aspect of the present invention, the orders of the modes are 0, 1 or 2.

The crucibles may be made in regular or irregular shapes. In one exemplary aspect of the present invention, circular cylindrical lucent crucibles are used. In other aspects, rectangular crucibles may be used.

In one aspect of the present invention, for circular cylindrical crucibles, diameter (d), length (l) and operating frequency (f) fall within the following ranges—with (d) and (l) in cm and (f) in MHz:
- the square of the quotient formed by diameter divided by the length, $(d/l)^2$, is between 0 and 100, and
- the square of the product of diameter times frequency, $(d \times f)^2$, is between 0 and $2 \times 10^9$.

In one exemplary aspect:

$0<(d/l)^2<20$ and $0<(d \times f)^2<1.5 \times 10^9$.

Figure 15:
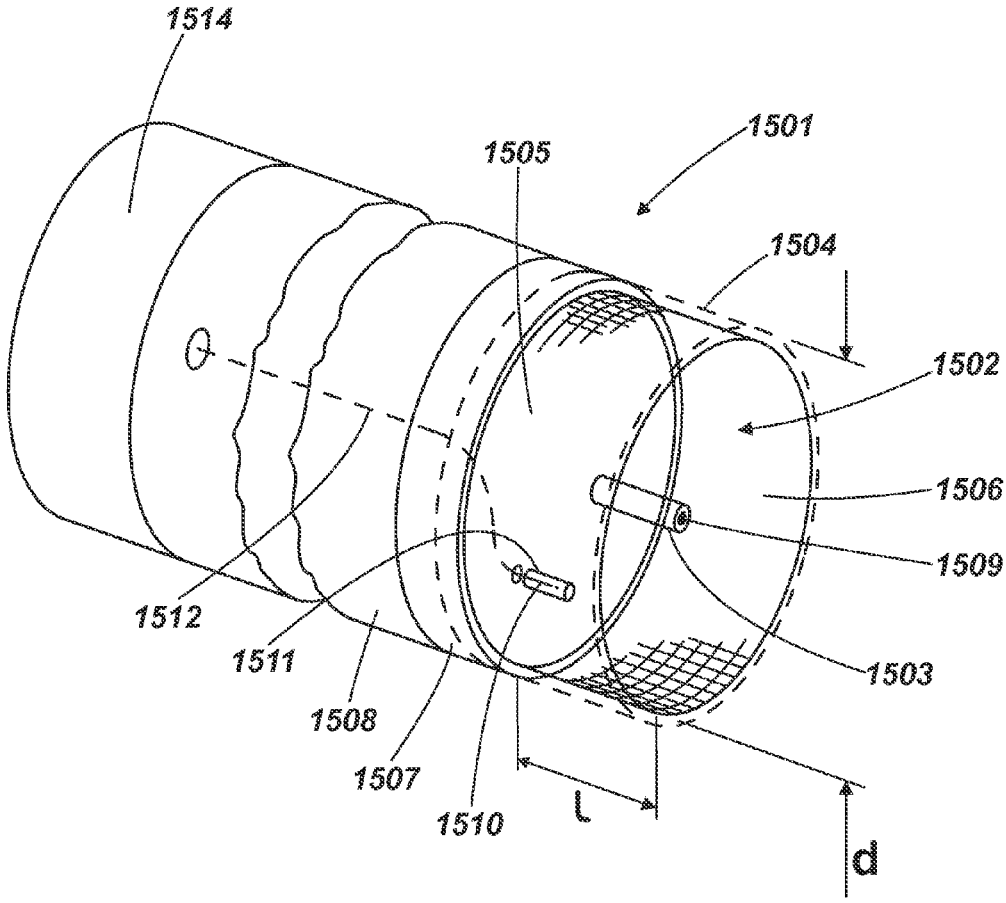
FIG. 15 is a perspective view of a lucent plasma crucible according to aspects of the present invention.
Figure 16:
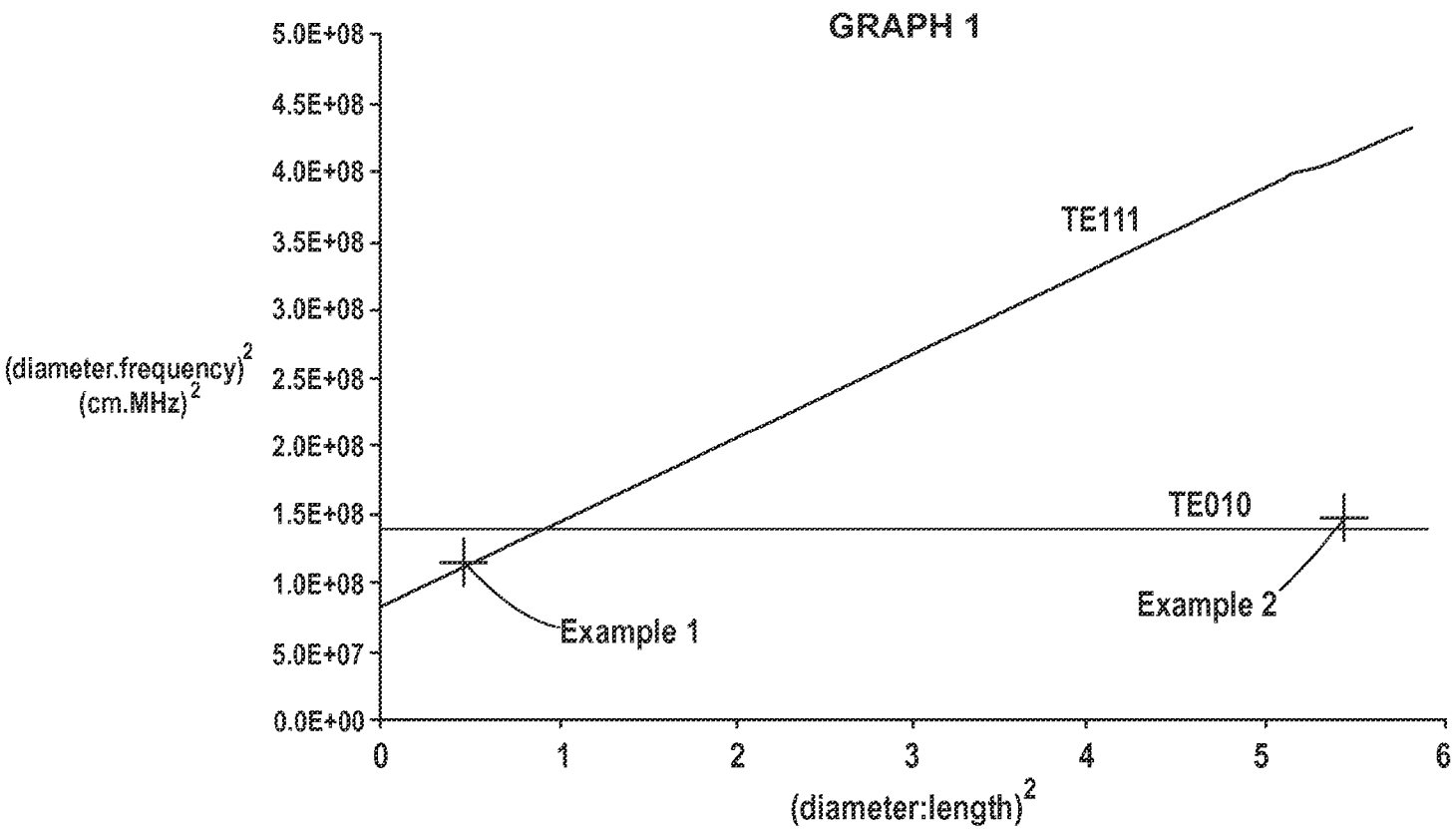
FIG. 16 shows Graph 1 as a known mode plot adapted to certain frequency and dielectric material, according to aspects of the present invention.
Figure 17:
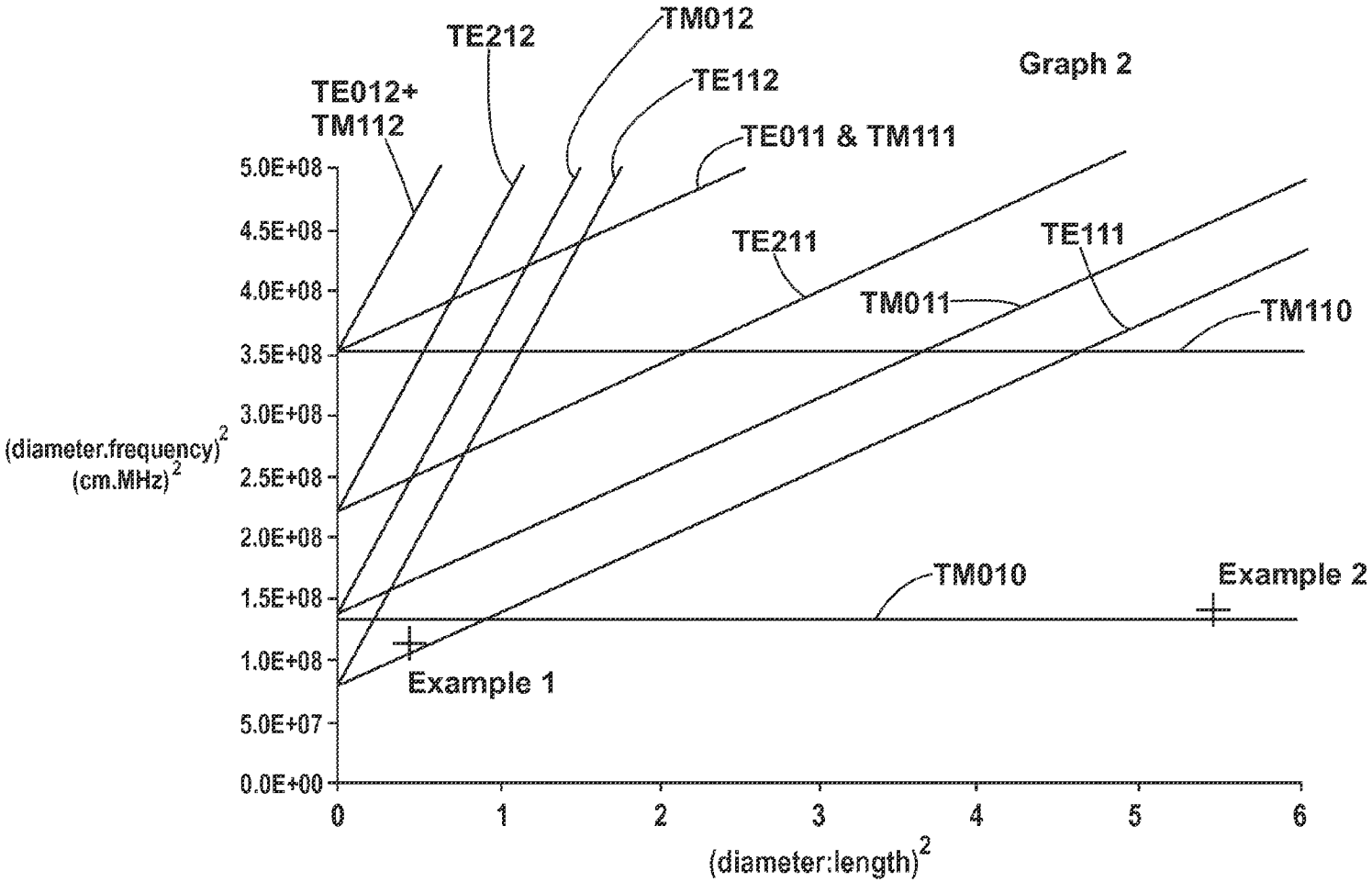
FIG. 17 shows Graph 2 as a mode plot including certain additional modes, according to aspects of the present invention.

To help the understanding of the invention, an exemplary embodiment is described by way of example and with reference to FIG. 15, FIG. 16 and FIG. 17 of the drawings.

FIG. 15 is a perspective view of a lucent plasma crucible, according to aspects of the invention.

In FIG. 15, a light source 1501 to be powered by microwave energy is shown. The source has a circularly cylindrical piece of quartz, forming a solid plasma crucible 1502. Quartz is transparent to visible light and the outer surfaces of the quartz crucible are polished. The crucible 1502 has a length 1 and a diameter d. Aligned centrally is a void 1503. The void 1503 is shorter and of smaller diameter with respect to the outer dimensions of the crucible 1502 itself. The void 1503 is sealed by working of the material of the crucible or by an additional piece of quartz.

A Faraday cage 1504 surrounds a curved side surface 1505 and one end surface 1506 of the crucible 1502. The Faraday cage can be of metallic mesh or reticular metallic sheet, such that the majority of light generated in the crucible can pass through the cage 1504. At the same time microwaves cannot pass through the Faraday cage 1504. A band 1507 of the cage 1504 extends around one end of a carrier 1508 to fasten the cage 1504, and the crucible 1502, to the carrier 1508. The carrier 1508 may then be used for carrying the crucible as well.

The crucible 1502 is filled with a fill of microwave excitable material 1509. The fill 1509 may be a metal halide in a noble gas to form a light-emitting plasma in the crucible. An antenna 1510 is arranged in a bore 1511 extending within the plasma crucible 1502 for transmitting plasma-inducing microwave energy to the fill. The antenna 1510 has a connection 1512 extending outside the plasma crucible for coupling to a source of microwave energy 1514—the source being shown diagrammatically. Various types of microwave source 1514 and means for feeding microwave energy into the connection 1512 may be used.

A TE111 mode and a TM010 mode are presented below as examples of lucent crucibles having lit plasma according to aspects of the present invention. In the following examples, the lucent crucibles use quartz, which has a dielectric constant of 3.78, as the material of the lucent crucible and are operated at a frequency of 2,450 MHz.

Example 1

TE111 Mode

In this example, the plasma crucible is 4.38 cm in diameter and 6.43 cm in length. The sealed plasma void is placed centrally on the central axis, with the antenna re-entrant being on the central axis at one end.

For operation in this mode, the length (l) and the diameter (d) can be varied, provided that they satisfy the equation:

$$(d\times f)^2=A+B(d/l)^2$$

where (f) is the frequency and A and B are constants having the following values:

$$A=8.0\times10^7$$

$$B=6.0\times10^7$$

An accompanying Graph 1 in FIG. 16 shows a plot of this equation, marked TE111, as a constant gradient line.

In the example marked as Example 1, TE111, in FIG. 16:

$$(d/l)^2=0.46 \text{ and}$$

$$(d\times f)^2=1.15\times10^8.$$

Example 2

TM010 Mode

In Example 2, shown on FIG. 16, the plasma crucible is 4.9 cm in diameter and 2.1 cm in length. Again, the sealed plasma void is placed centrally on the central axis, with the antenna re-entrant being at one end, but offset from the central axis and close to the central void.

For operation in the TM010, the length can vary independently of diameter, which remains constant.

The equivalent plot marked TM010 is shown on Graph 1 of FIG. 16 as Example 2, with $$A=1.4\times10^8$$

$$B=0$$

The plot corresponding to Example 2 is a horizontal line.

In the example marked as Example 2 on FIG. 16:

$$(d/l)^2=5.44 \text{ and}$$

$$(d\times f)^2=1.44\times10^8.$$

It should also be noted that the positions of the examples with respect to the plots, which are in accordance with resonant cavity theory, are slightly high. These examples have been tried and found to work. If the filled void occupies a significant proportion of the volume of the crucible, an adjusted value of the dielectric constant should be used. The adjusted value is an average dielectric constant value for the volume that is formed by both the quartz and the void where the dielectric constant is 1.00 for the void and 3.78 for the quartz. The adjustment is in inverse proportion to the square root of the dielectric constant resulting in a small increase in both d and l. However for practical purposes, where the void remains a small proportion of the crucible volume, the adjustment can be ignored.

Also it should be noted that the TE111 mode is a higher Q mode, resulting in a higher electric field strength in the crucible for starting of the plasma.

The dimensions of crucible for the TE111 mode given in the Example 1 above are close to those given in connection with FIG. 9 and FIG. 10. Other dimensions are possible for operation in the TE111 mode. For instance, both d and l can be equal to 4.85 cm as set forth in Table 1 below. The diameter can be smaller than this number, but greater than 4.47 cm. In another aspect of the present invention, the diameter can be smaller at 3.74 cm with the length being greater at 18.71 cm. Alternatively the diameter can be larger at 7.29 cm with the length being half the diameter at 3.65 cm.

The invention is not intended to be restricted to the details of the above two modes.

Graph 1, shown in FIG. 16, is a mode plot adapted to the frequency and dielectric material in question. Graph 2 in FIG. 17 shows certain additional modes. Table 1 below shows typical dimensions of quartz plasma crucibles for additional modes having a d/l ratio of 1.00 with the diameters being equal to the lengths.

TABLE 1

| Mode | Length - l - cm | Diameter - d - cm |
|---|---|---|
| TE111 | 4.85 | 4.85 |
| TE211 | 6.88 | 6.88 |
| TE112 | 7.29 | 7.29 |
| TE011 | 8.30 | 8.30 |
| TE212 | 8.78 | 8.78 |
| TE012 | 9.93 | 9.93 |
| TM010 | 4.82 | 4.82 |
| TM110 | 7.68 | 7.68 |
| TM011 | 5.75 | 5.75 |
| TM111 | 8.30 | 8.30 |
| TM012 | 7.93 | 7.93 |
| TM112 | 9.93 | 9.93 |

Graph 2 shows these additional modes. From their position on the graph, it will be appreciated that certain of the additional modes require larger dimensions of quartz crucibles. Whilst all of the above dimensions fall within a nominal practical limit on size of 10 cm, the modes can be classified as set forth below.

Modes for which a wide range of the d/l ratio is available are:

TE111

TM010.

Modes for which a considerable range of the d/l ratio is available, although one dimension can get excessive are:

TE211
TE112
TM110
TM011
TM012.

Modes for which a restricted range of the d/l ratio is available, with either or both dimensions being liable to be excessive are:

TE011
TE212
TM111.

Modes for which either or both dimensions are liable to be excessive regardless of the value of d/l are:

TE012
TM112.

Certain of these modes have a higher Q than others.

The following Table 2 shows Q values:

TABLE 2

| Mode | Q Factor |
|---|---|
| TE111 | 0.27 |
| TE211 | 0.31 |
| TE112 | 0.45 |
| TE011 | 0.56 |
| TE212 | 0.43 |
| TE012 | 0.67 |
| TM010 | 0.13 |
| TM110 | 0.20 |
| TM011 | 0.16 |
| TM111 | 0.22 |
| TM012 | 0.18 |
| TM112 | 0.24 |

Taking account of both dimensional considerations and Q considerations, the following modes provide more flexibility regarding dimension and higher Q factor values:

TE111
TE211
TE112
TE011
TE212.

The present invention has been described in relation to particular examples, which are intended to be illustrative rather than restrictive, with the scope and spirit of the invention being indicated by the following claims and their equivalents.

The invention claimed is:

1. A lucent plasma crucible comprising:

a closed translucent or transparent body forming a void for containing a light emitting plasma; and a fill material being filled in the void, the fill material being excitable by microwave energy to form the light emitting plasma, wherein the body is substantially right circular cylindrical and is dimensioned to have:

low order transverse electric (TE) microwave mode properties, or low order transverse magnetic (TM) microwave mode properties.

2. The lucent plasma crucible of claim 1, wherein modes are selected from 0, 1 or 2.

3. The lucent plasma crucible of claim 1, wherein the body is a right circular cylinder, 63 mm long and 43 mm in diameter, an made from quartz.

4. The lucent plasma crucible of claim 1, wherein the mode is chosen from the following modes:

TE111,
TE211,
TE112,
TE011, and
TE212.

5. The lucent plasma crucible of claim 1, wherein diameter (d), length (l) and operating frequency (f) fall within following ranges:

square of a quotient formed by the diameter divided by the length, $(d/l)^2$, is between 0 and 100 and square of a product formed by the diameter times the frequency, $(d\times f)^2$, is between 0 and $2\times10^9$ wherein d and l are expressed in cm and f is expressed in MHz.

6. The lucent plasma crucible of claim 5, wherein $(d/l)^2$ is between 0 and 20.

7. The lucent plasma crucible of claim 5, wherein $(d\times f)^2$ is between 0 and $1.5\times10^9$.

8. The lucent plasma crucible of claim 1, wherein the body is made of quartz.

9. A light source to be powered by microwave energy, the source comprising:

a solid plasma crucible of material being lucent to exit of light, the plasma crucible having a sealed void in the plasma crucible and wherein the plasma crucible is substantially right circular cylindrical;

a Faraday cage surrounding the plasma crucible, the cage containing microwaves while being at least partially light transmitting to permit exit of light from the plasma crucible;

a fill contained by the void, the fill being of material excitable by microwave energy to form a light emitting plasma; and an antenna arranged within the plasma crucible for transmitting plasma-inducing microwave energy to the fill, the antenna having a connection extending outside the plasma crucible for coupling to a source of microwave energy, wherein the lucent plasma crucible has:

low order transverse electric microwave mode, or low order transverse magnetic microwave mode properties.

10. The light source of claim 9, wherein the modes are chosen from the following modes:

TE111,
TE211,
TE112,
TE011, and
TE212.

11. The light source of claim 9, wherein the plasma crucible is made from quartz.

12. The light source of claim 9, wherein modes are 0, 1 or 2.

13. The light source of claim 9, wherein the plasma crucible is a circular cylindrical lucent crucible.

14. The light source of claim 13, wherein diameter (d), length (l) and operating frequency (f) fall within following ranges:

square of a quotient formed by dividing the diameter by the length, $(d/l)^2$, is between 0 and 100, and square of a product formed by multiplying the diameter times frequency, $(d\times0^2$, is between 0 and $2\times10^{9'}$ wherein d and l are expressed in cm and f is in MHz.

15. The light source of claim 14, wherein $(d/l)^2$ is between 0 and 20.

16. The light source of claim 14, wherein $(d \times f)^2$ is between 0 and $1.5 \times 10^9$.

* * * * *